US008499691B2

(12) United States Patent
Bangel et al.

(10) Patent No.: US 8,499,691 B2
(45) Date of Patent: Aug. 6, 2013

(54) PRINTING UNIT, PRINTING PRESS AND PROCESS FOR PRODUCING LABELS IN A PRINTING PRESS

(75) Inventors: Dieter Bangel, Hüttenberg (DE); Thomas Demand, Wetzlar (DE)

(73) Assignee: Gallus Druckmaschinen GmbH, Langgoens-Oberkleen (DE)

( * ) Notice: Subject to any disclaimer, the term of this patent is extended or adjusted under 35 U.S.C. 154(b) by 845 days.

(21) Appl. No.: 12/400,008

(22) Filed: Mar. 9, 2009

(65) Prior Publication Data

US 2009/0223394 A1 Sep. 10, 2009

(30) Foreign Application Priority Data

Mar. 10, 2008 (DE) ..... 10 2008 013 315

(51) Int. Cl.
*B41F 13/24* (2006.01)
*B41F 13/008* (2006.01)

(52) U.S. Cl.
USPC ..... 101/219; 101/247; 101/145

(58) Field of Classification Search
USPC ..... 101/247, 139, 145, 182, 219
See application file for complete search history.

(56) References Cited

U.S. PATENT DOCUMENTS 1,934,776 A * 11/1933 Stoessel ..... 101/152
3,098,434 A * 7/1963 Lime ..... 101/178
3,443,516 A 5/1969 Schnall
5,134,934 A 8/1992 Knauer et al.
5,142,977 A 9/1992 Gertsch et al.
5,690,029 A 11/1997 Herrmann et al.
6,694,877 B1 2/2004 Wolters et al.
6,817,292 B2 11/2004 Gerner et al.
7,111,552 B2 * 9/2006 Kolbe et al. ..... 101/216
7,484,458 B2 2/2009 Christel et al.

(Continued)

FOREIGN PATENT DOCUMENTS

DE 1265759 B 4/1968
DE 4021895 A1 1/1992

(Continued)

OTHER PUBLICATIONS

German Search Report dated Sep. 5, 2008.

(Continued)

*Primary Examiner* — Leslie J Evanisko
(74) *Attorney, Agent, or Firm* — Laurence A. Greenberg; Werner H. Stemer; Ralph E. Locher

(57) ABSTRACT

A printing unit of compact construction includes an impression cylinder and a printing form cylinder to be pivoted around the impression cylinder about a pivot axis running parallel to an axis of rotation of the impression cylinder. A spacing between the axes of rotation of the printing form cylinder and of the impression cylinder can be varied and the printing form cylinder and the impression cylinder can be set against each other, to form a press nip in which a substrate can be printed. A first drive for producing a rotational movement of the printing form cylinder is connected to the printing form cylinder through a drive train. At least one component of the drive train has a torque axis running through the impression cylinder. A printing press having at least one printing unit and a process for producing labels or self-adhesive labels in a printing press, are also provided.

27 Claims, 11 Drawing Sheets

U.S. PATENT DOCUMENTS

| | | | | |
|---|---|---|---|---|
| 2005/0160928 | A1 * | 7/2005 | Motard et al. | 101/217 |
| 2005/0188865 | A1 | 9/2005 | Ruoff et al. | |
| 2006/0156934 | A1 | 7/2006 | Arabin et al. | |

FOREIGN PATENT DOCUMENTS

| | | | |
|---|---|---|---|
| DE | 4435986 | A1 | 4/1996 |
| DE | 29722735 | U1 | 2/1998 |
| DE | 10046368 | A1 | 4/2002 |
| DE | 10215261 | A1 | 10/2002 |
| EP | 0352483 | A2 | 1/1990 |
| EP | 0353194 | A2 | 1/1990 |
| EP | 1101611 | A1 | 5/2001 |
| EP | 1568493 | A1 | 8/2005 |
| GB | 1147778 | A | 4/1969 |
| WO | 2005028202 | A1 | 3/2005 |

OTHER PUBLICATIONS

European Search Report dated Jun. 25, 2009.

* cited by examiner

PRINTING UNIT, PRINTING PRESS AND PROCESS FOR PRODUCING LABELS IN A PRINTING PRESS

CROSS-REFERENCE TO RELATED APPLICATION

This application claims the priority, under 35 U.S.C. §119, of German Patent Application DE 10 2008 013 315.9, filed Mar. 10, 2008; the prior application is herewith incorporated by reference in its entirety.

BACKGROUND OF THE INVENTION

Field of the Invention

The invention relates to a printing unit having an impression cylinder as well as a printing form cylinder which can be pivoted around the impression cylinder about a pivot axis running parallel to the axis of rotation of the impression cylinder. A spacing between the axes of rotation of the printing form cylinder and of the impression cylinder can be varied and the printing form cylinder and the impression cylinder can be set against each other, so that a press nip is formed in which a substrate can be printed. A first fixed-location drive for producing a rotational movement of the printing form cylinder is provided. The invention furthermore relates to a printing press having such a printing unit and a process for producing labels in a printing press.

Particularly high requirements are increasingly placed on printing presses conceived or employed for label printing or packaging printing, with regard to economy and simplicity of operation, with maximized variability for the product manufacture at the same time. For instance, such a printing press is intended to cause as few rejects as possible, for example during conversion between various print jobs, as well as between different printing processes or printing lengths. Familiar narrow web in-line printing presses constructed for label printing, in particular self-adhesive label printing, normally have a machine structure in which a printing material or a substrate is led over a large number of cylinders and rollers between various process levels (for example for printing and for drying), so that a not inconsiderably long web section is stored in the printing press and corresponding rejects can potentially arise. A label printing press that can be converted between different printing processes is described in International Publication No. WO 2005/028202 A1, corresponding to U.S. Patent Application Publication No. US 2006/0156934 A1. In order to ensure that only a comparatively short web section is stored in the printing press for a different machine structure, it is primarily a printing unit configuration that is needed, which firstly permits the desired variability in relation to printing processes and printing lengths and secondly permits a short web path.

In order to set individual cylinders on and off in a printing unit, provision is frequently made for the cylinders to be held in such a way that they can be pivoted. In German Published, Non-Prosecuted Patent Application DE 44 35 986 A1, corresponding to U.S. Pat. No. 5,690,029, an offset printing unit having a corresponding device for setting the blanket cylinder on and off is disclosed. Setting of the optimal pressure and adaptation to the printing material thickness can be achieved through the use of displacing swinging arms. For example, a printing unit with a variable printing length for offset printing is described in European Patent Application EP 1 101 611 A1, corresponding to U.S. Pat. No. 6,694,877. Bearing arms are pivoted about an axis through the use of spindle drives in order to move the axes of rotation of the printing form cylinder, of the blanket cylinder and of the impression cylinder away from one another or toward one another. Printing press cylinders and blanket cylinders of different formats can be used in the printing unit.

In UK Patent GB 1,147,778, corresponding to U.S. Pat. No. 3,443,516, an embodiment of an offset printing unit of a sheet-fed printing press is described in which, in order to set it on and off, the blanket cylinder can be pivoted through the use of a bearing arm about the axis of rotation of the printing form cylinder, and it is possible for the blanket cylinder to be raised off the printing form cylinder at the same time in a superimposed radial movement.

SUMMARY OF THE INVENTION

It is accordingly an object of the invention to provide a compact printing unit, a printing press and a process for producing labels in a printing press, which overcome the hereinafore-mentioned disadvantages of the heretofore-known devices and processes of this general type and in which a printing form cylinder can be set off the cylinders making contact with it for the purpose of format variation.

With the foregoing and other objects in view there is provided, in accordance with the invention, a printing unit, comprising an impression cylinder having an axis of rotation and a printing form cylinder having an axis of rotation. The printing form cylinder is configured to be pivoted around the impression cylinder about a pivot axis running parallel to the axis of rotation of the impression cylinder. The axes of rotation of the impression cylinder and of the printing form cylinder define a variable spacing therebetween. The impression cylinder and the printing form cylinder are configured to be set against each other to form a press nip in which a substrate can be printed. A first fixed-location drive is provided for producing a rotational movement of the printing form cylinder. A drive train connects the first drive to the printing form cylinder and the drive train includes at least one component having a torque axis running through the impression cylinder.

The torque axis has the orientation of the torque acting on the component of the drive train and runs through the point of the component at which the torque acts. Advantageously, a compact drive train for producing the rotational movement of the printing form cylinder can be implemented. The printing unit according to the invention only needs little overall space and is assembled inexpensively from a few components.

In accordance with another feature of the invention, the torque axis of the first drive and/or the pivot axis can in particular run through the impression cylinder. In other words, the torque axis of the first drive and/or the pivot axis can in particular lie within the contour of the impression cylinder, in particular intersect the body of the volume of the impression cylinder. Furthermore or alternatively, as the printing form cylinder is pivoted about the pivot axis, the impression cylinder can lie at least partly in a circular segment bounded by a line sweeping over the axis of rotation of the printing form cylinder. In other words, the printing form cylinder can be pivoted around the impression cylinder and not pivoted away from the latter. The pivot axis, as viewed from the axis of rotation of the printing form cylinder, can lie within the printing form cylinder or behind the printing form cylinder. The variation in the spacing of the axes of rotation can be carried out along a linear or straight path. In particular, an element that holds the printing form cylinder can be pivoted, and it is possible for the distance between the holder of the printing form cylinder and the pivot axis to be adjusted.

In accordance with a further feature of the invention, which is particularly advantageous for label printing, the printing unit according to the invention can be constructed to carry out a flexographic printing process or to carry out a book printing process or to carry out a gravure printing process.

In accordance with a group of advantageous embodiments of the printing unit according to the invention, the first drive is connected to the printing form cylinder through a train of gears coupled to one another by arms. The gear train in this group forms the drive train. In particular, the gear train can include first, second and third gears, of which the first gear is connected to the second gear by a first coupling arm, and the second gear is connected to the third gear by a second coupling arm.

In accordance with an added feature of the invention, in the printing unit, the torque axis of the first drive can preferably run parallel to a central cylinder axis of the impression cylinder and/or be identical to the central cylinder axis of the impression cylinder. Furthermore or alternatively, the pivot axis of the printing form cylinder can run along the central cylinder axis of the impression cylinder and/or the impression cylinder can be fixed in its location in the printing unit.

In accordance with an additional feature of the invention, in concrete terms, in the printing unit, in order to carry out a coupled pivoting movement and variation of the spacing of the printing form cylinder, a slider can be provided that can move in a slotted guide, which can be pivoted about the pivot axis, and that makes contact, with a guide cam follower connected to the printing form cylinder, against a guide cam that is fixed in its position or adjustable (in particular for fine adjustment).

In accordance with yet another feature of the invention, in an advantageous optional development of the printing unit, the impression cylinder is connected to a second fixed-location drive through another drive train. The second drive is different from the first drive. The other drive train is not identical to the drive train for the printing form cylinder. In particular, the second drive can be connected to the impression cylinder through a gear train. Furthermore or alternatively, the torque axis of the second drive can preferably run outside the impression cylinder. In addition, the first drive and/or the second drive can in each case be a servo motor.

In accordance with yet a further feature of the invention, the printing form cylinder can be held in such a way that it is connected detachably in the printing unit. The printing unit according to the invention can also have a variable format, in that printing form cylinders with different diameters can be accommodated in the printing unit. Alternatively thereto, intermediate sleeves with different diameters can be accommodated on the printing form cylinder.

With the objects of the invention in view, there is also provided a printing press, in particular a label printing press related to the concept according to the invention, comprising at least one printing unit according to the invention.

The printing press according to the invention is distinguished by at least one printing unit according to the invention having features or feature combinations according to this description. The printing press preferably has an in-line construction and/or is modular with regard to individual structural groups, in particular the printing units or printing unit groups, including their load-bearing structures. The printing press according to the invention can have a plurality of printing units, in particular four printing units for multicolor printing. The printing press can have a plurality of printing units according to the invention.

In accordance with another feature of the invention, the substrate can be in web form. In particular, the substrate can be a multilayer material web, especially a self-adhesive label material on a supporting web. The printing press can be a web-processing printing press. It can have a transport device for moving the web-like substrate through the printing press. The printing press can be a so-called narrow web printing press. The width of the web to be printed can be less than 900 mm, in particular less than 515 mm. Typical widths for embodiments of narrow web printing presses according to the invention are in particular 330 mm and 280 mm.

In accordance with a further feature of the invention, the printing press can, moreover, also have the following features, individually or in combination: a printing unit according to the invention can be held on a frame wall with the two fixed-location drives (first drive and second drive) integrated into the frame wall. The printing press can have holding elements, on which modules for different printing processes or for processing/finishing the substrate can be accommodated interchangeably in such a way that they can be connected in a detachable manner. Printing processes can be in particular: flexographic printing, gravure printing, book printing, offset printing, direct or indirect planographic printing, film embossing printing, screen printing, inkjet printing or xerographic printing. Processing can in particular be: stamping, cutting, punching out, perforating, grooving, folding or varnishing. Expressed in another way, the printing press can have a (standardized or neutral) interface, so that printing unit or processing unit components can be accommodated in such a way that they can be connected to the printing press. In particular, components that can be used through all these units or components supplementing all these units, in each case for functional serviceability, can directly be part of the printing press. The printing press can have a plurality of printing units which operate in accordance with mutually different printing processes. The order of the individually disposed printing units and/or processing units can be selected or adapted in accordance with a print job.

In accordance with an added feature of the invention, in a group of particularly preferred embodiments of printing presses, the printing unit according to the invention is held through the use of a bearing element in a load-bearing element fabricated at least partly from stone.

In accordance with an additional feature of the invention, the printing unit according to the invention can be held through the use of a bearing element in a load-bearing element fabricated at least partly from stone, in particular natural stone or a composite material having natural stone. A printing press having a load-bearing element fabricated at least partly from stone is described in German Published, Non-Prosecuted Patent Application DE 10 2006 042 884 A1, corresponding to U.S. Patent Application Publication No. US 2008/0063458, which will become known to a person skilled in the art addressed by this description of the printing unit according to the invention and the complete contents of the disclosure of which links the person skilled in the art with this description of the printing unit according to the invention. Both documents with the complete contents of the disclosure thereof are hereby incorporated by explicit reference into the disclosure of this application.

In connection with the invention, the term stone used herein is understood to mean a solid mineral mass or any individual object being formed of such material. Stone can be natural stone or artificial stone. Natural stone is a solid mineral mass produced over the course of the history of the Earth, part of the inorganic constituents of the Earth's crust or an individual object being formed of this material. Natural stone can be produced by solidification of molten minerals (basalt, granite, volcanic rocks) or loose material as a result of compaction (sandstone, limestone). Artificial stones, on the other hand, can be obtained by industrial processes.

The load-bearing element in these embodiments is formed of stone, in particular of one or more stones, preferably entirely of stone. In particular, large parts of the machine load-bearing structure or the entire machine load-bearing structure can be fabricated from stone. The entire printing unit is preferably accommodated in the load-bearing element. In some of the embodiments of the printing press according to the invention, a plurality of printing units can be accommodated in the one load-bearing element. Furthermore or alternatively to this, the machine load-bearing construction can have a plurality of load-bearing elements which are fabricated from stone. The load-bearing element or elements can be fabricated from a monobloc or a monolith. In particular, the load-bearing element fabricated from stone for the printing press according to the invention can be a base frame, a machine frame, a machine foundation, a base plate, a base unit, a printing unit frame, a printing unit lower part, a side cheek, a side wall, a side frame, a load-bearing wall, a portal support or a connecting profile.

In a first group of embodiments of the printing press according to the invention, the stone is a natural stone. In other words, the load-bearing element can be fabricated from a naturally occurring stone. In particular, the natural stone can be an igneous rock, a deep-seated rock, or a metamorphic rock. The natural stone is preferably a granite, a granite-like rock, a granite porphyry, a gneiss or a marble. In particularly advantageous embodiments, the natural stone is a black granite, a gabbro or an impala granite.

The printing unit according to the invention can also be a compact printing unit having further features as are described in German Published, Non-Prosecuted Patent Application DE 10 2007 045 876 A1, or part of a compact printing press having further features as described in German Published, Non-Prosecuted Patent Application DE 10 2007 045 876 A1. That publication will also become known to the person skilled in the art addressed by this description of the printing unit according to the invention. German Published, Non-Prosecuted Patent Application DE 10 2007 045 876 A1 with the complete contents of the disclosure thereof is hereby incorporated by explicit reference in the disclosure of this application.

With the objects of the invention in view, there is concomitantly provided a method for producing labels or self-adhesive labels in a printing press. According to the invention, a printing press having features or feature combinations according to this description is operated and processes a web-like substrate which is suitable for the production of labels or self-adhesive labels.

Other features which are considered as characteristic for the invention are set forth in the appended claims.

Although the invention is illustrated and described herein as embodied in a printing unit, a printing press and a process for producing labels in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
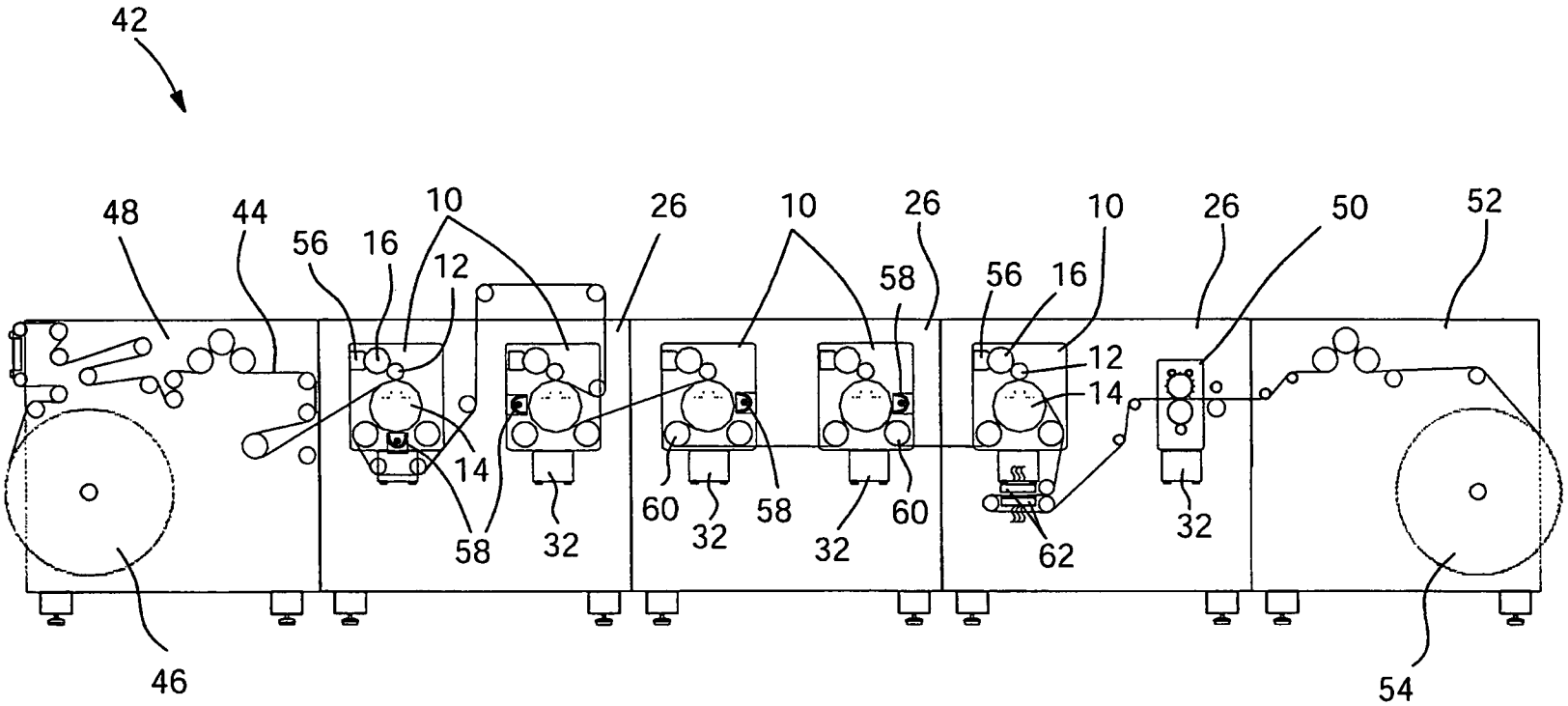
FIG. 1 is a diagrammatic, longitudinal-sectional view of a preferred embodiment of a printing press according to the invention.

Referring now to the figures of the drawings in detail and first, particularly, to FIG. 1 thereof, there is seen a preferred embodiment of a printing press 42 according to the invention, more accurately a label printing press according to the invention, with an in-line construction having printing units 10 according to the invention following in the horizontal direction. The label printing press is used to process a substrate 44 in web form. The substrate is unrolled from a substrate roller 46 in a feed part 48 of the printing press 42 and led along a path through the printing press 42. The printing press 42 has a plurality of frame modules 26, which are shown as three frame modules 26 by way of example in this case. In this embodiment, in each case two printing units 10 or one printing unit 10 and one processing unit 50, in this case a stamping unit for punching out the labels on the web-like substrate 44, are accommodated on the frame module 26. An outlet part 52, in which the finished products are wound up into a label roller 54, follows after the individual processing stations. The feed part 48, the frame modules 26 and the outlet part 52 are connected to each other in such a way that they can be detached or separated. The printing press 42 is constructed modularly.

In the illustration of the individual printing units 10 in FIG. 1, which are flexographic printing units in this case, in addition to printing form cylinders 12, impression cylinders 14 and ink applicator rollers 16, chamber-type doctors 56 are also shown. Furthermore, the printing units 10 in the printing press 42 have diverse drying devices. The impression cylinders 14 are assigned UV drying devices 58 disposed downstream of the respective press nip of the printing unit 10, so that the printed substrate 44 can be dried directly on the impression cylinder 14. The printing units 10 also have web guide rollers 60, which may be part of a transport device, for guiding the web-like substrate 44. In the embodiment shown in FIG. 1, the fifth printing unit 10 includes a hot air drying device 62 both for the top side and for the underside of the substrate 44. The hot air drying device 62 is disposed downstream of the fifth printing unit 10 and the web-like substrate is led through the hot air drying device 62. In other embodiments of the printing press 42 according to the invention, a hot air drying device 62 can also be provided in an analogous way on further printing units. The individual printing units 10 and the processing unit 50 are fixed to the frame modules 26 of the printing press 42 by a holding element 32. The second printing unit 10 is operated in verso printing, by way of example.

Figure 2:
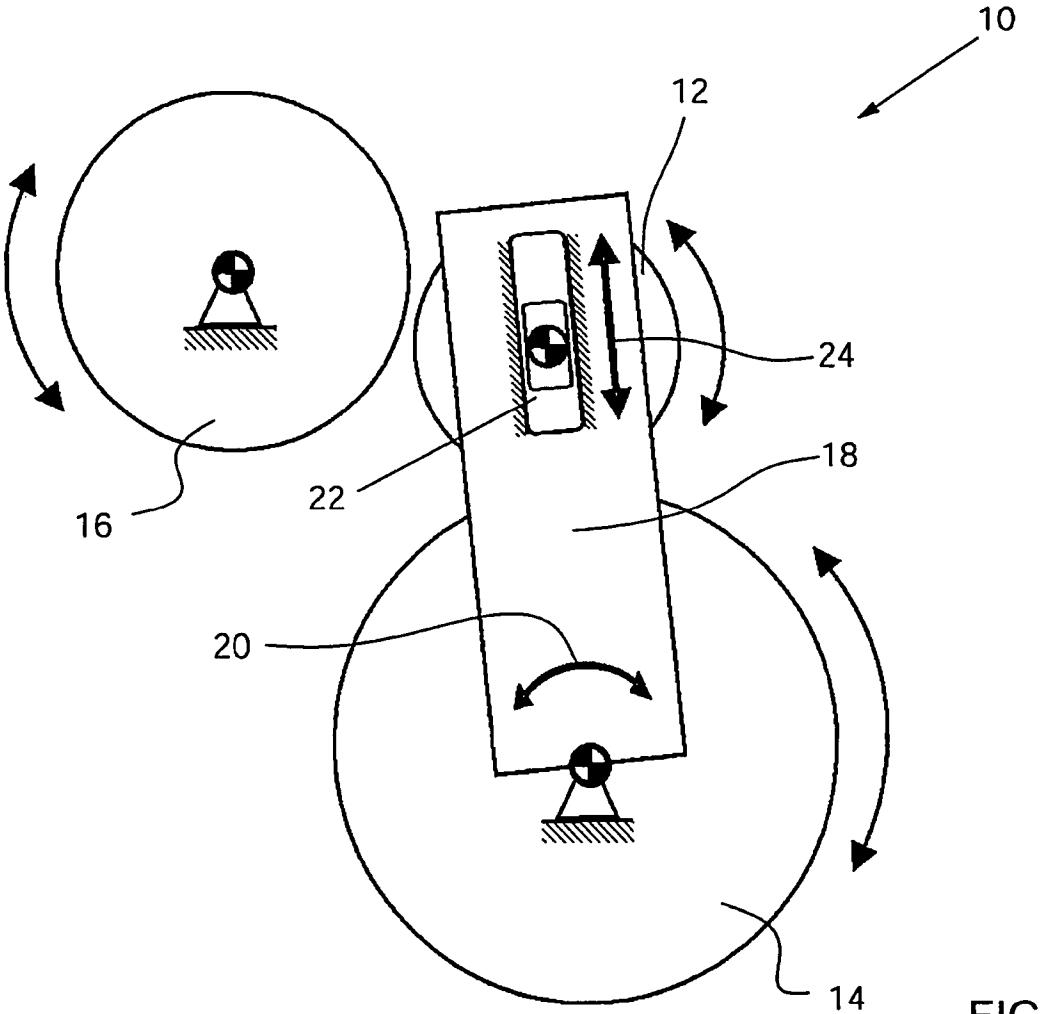
FIG. 2 is an enlarged, longitudinal-sectional view of a preferred embodiment of a printing unit according to the invention, used to explain degrees of freedom of movement.

FIG. 2 shows an embodiment of the printing unit 10 according to the invention for flexographic printing, including a printing form cylinder 12, an impression cylinder 14 and an ink applicator roller 16, more precisely an engraved roller. The cylinders can in each case be rotated about their axes shown in the figure, with the impression cylinder 14 and the ink applicator roller 16 being accommodated in such a way as to be fixed to the frame in the printing press. The impression cylinder 14 is disposed at the center of the printing unit 10. Through the use of a swinging arm 18, which is a bearing arm and, in particular, is only or exactly one swinging arm 18, the printing form cylinder 12 is pivoted about the axis of rotation of the impression cylinder 14 (pivoting movement 20). The swinging arm 18 is mounted on the axis of rotation of the impression cylinder 14. The swinging arm 18 can act on the drive side of the printing form cylinder 12, so that the latter is accessible to the operator on the operating side for the purpose of a format change. The swinging arm 18 has a linear guide 22, so that a linear variation 24 in the spacing between the printing form cylinder 12 and the impression cylinder 14 is carried out through the use of a physical displacement of the axis of rotation of the printing form cylinder 12 (without tilting the axis). This embodiment constitutes a simple printing unit construction with simple and precise printing form cylinder adjustment.

Figure 3B:
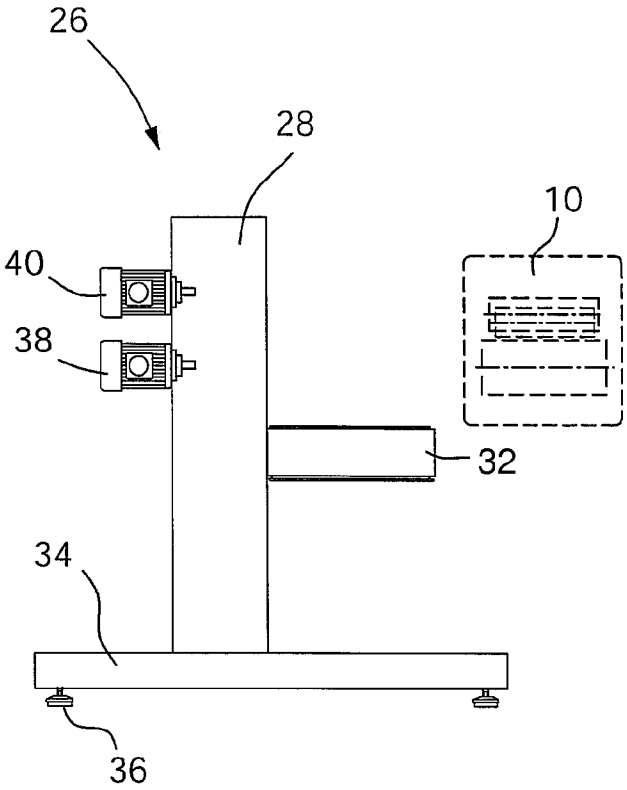
FIGS. 3A and 3B are two sectional views of an embodiment of a frame module for two printing units.
Figure 3A:
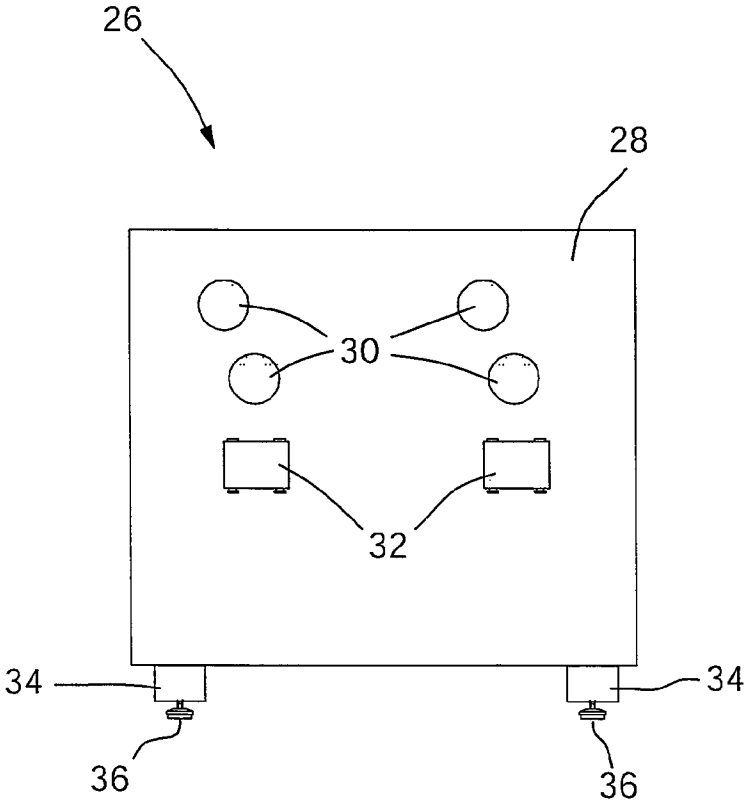

FIGS. 3A and 3B relate to an embodiment of a frame module 26 for two printing units 10 according to the invention. FIG. 3A is a view of the frame module 26: it includes a stone side wall 28, in practical terms an individual natural stone, in particular a granite or a monolith. There are four drive interfaces 30 provided for accommodating the printing unit modules, that is two drive interfaces 30 for each respective printing unit. In each case, a holding element 32 serves as a mechanical interface. The stone side wall 28 rests on two standing foot profiles 34. The frame module 26 can be aligned through the use of leveling elements 36. In FIG. 3B, the frame module 26 is shown from the side. Fixed to the rear of the stone side wall 26 are a first drive 38 and a second drive 40, that is servo motors in the practical case, which are accessible to the printing unit 10 through the drive interfaces 30.

Figure 4:
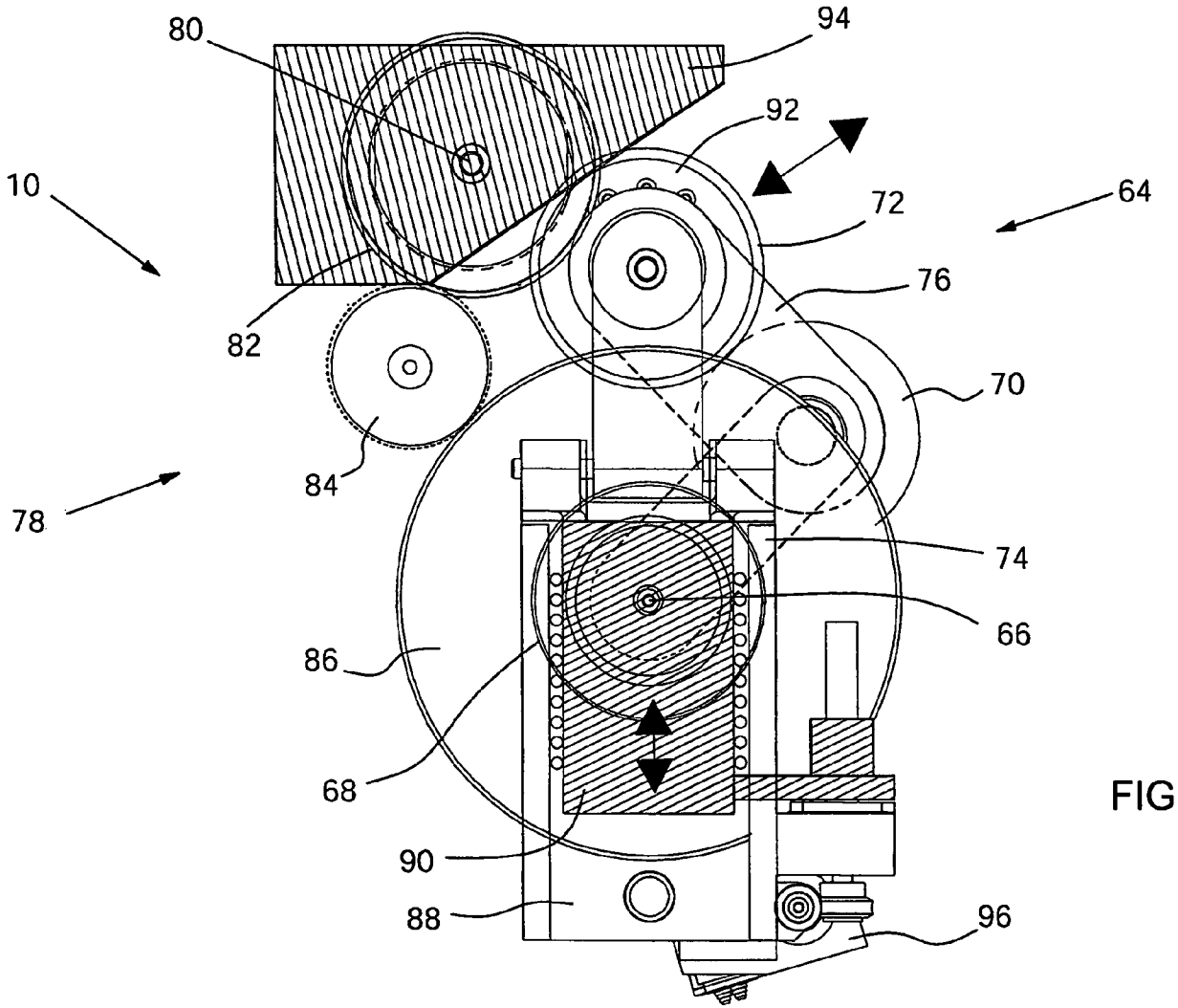
FIG. 4 is a partially sectional, operating-side view of an embodiment of a printing unit according to the invention in a setting for a small printing format.

FIG. 4 shows a mechanism for implementing individual movements in the printing unit 10 in an operating-side view of an embodiment of a printing unit 10 according to the invention in a setting for a small printing format (the printing form cylinder 12 has a relatively small diameter and a relatively short circumferential length). A drive train 64 for the rotation of the printing form cylinder 12 originates from a central axis 66 of the impression cylinder 14. A drive gear 68 of the first drive 38 is located concentrically with respect to the central cylinder axis 66. A torque axis of this drive gear 68 runs through the impression cylinder 14. The drive gear 68 forms a first gear in a train of interconnected gears. The drive gear 68 meshes with a first intermediate gear 70 (second gear), which in turn meshes with a driven gear 72 (third gear) of the printing form cylinder 12. The drive gear 68 is connected to the first intermediate gear 70 through the use of a first coupling arm 74, and the first intermediate gear 70 is connected to the driven gear 72 through the use of a second coupling arm 76.

Another drive train 78 is provided for the rotational movement of the impression cylinder 14 in this embodiment. A drive gear 82 of the second drive 40 is disposed on a drive axis 80 of the second drive 40. A torque axis of the second drive 40 runs parallel to the axis of rotation of the impression cylinder 14 and outside the impression cylinder 14. This drive gear 82 meshes with a second intermediate gear 84, which in turn meshes with a driven gear 86 for the impression cylinder 14. The first and the second drives 38, 40 are synchronized with each other. The swinging arm 18 of the printing unit 10 has a slotted guide 88, in which a slider 90 is accommodated in such a way that it can move linearly, in order to implement a combined or correlated pivoting movement with variation of the spacing. The slider 90 presses a guide cam follower 92, connected to the printing form cylinder 12, against a guide cam 94, which is accommodated in the printing unit 10 and has a position which is adjustable for the purpose of fine adjustment. The slider 90 can be moved through the use of an actuating element 96. The linear movement of the slider 90 leads firstly to a variation in the spacing of the axes of rotation of the impression cylinder 14 and of the printing form cylinder 12 and secondly, due to the action of the guide cam, also to a pivoting movement of the printing form cylinder 12 around the impression cylinder 14 (in this regard, also see FIG. 2).

Figure 5:
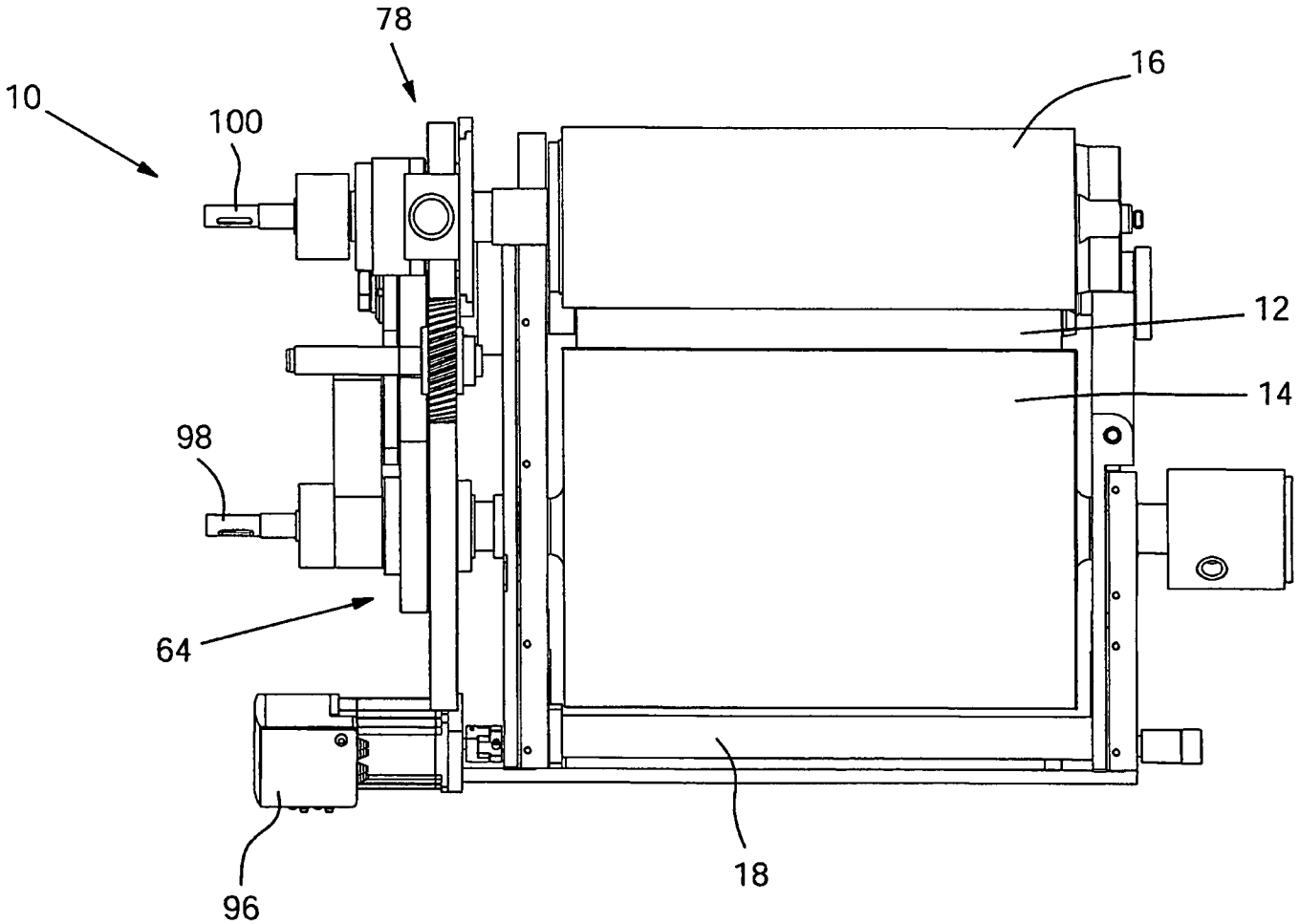
FIG. 5 is a first side-elevational view of an embodiment of a printing unit according to the invention in a setting for a small printing format.

FIG. 5 is a first side view of the embodiment of a printing unit 10 according to the invention from FIG. 4 in a setting for a small printing format. It is possible to see, firstly, the impression cylinder 14 in a fixed location in the printing unit 10 and the printing form cylinder 12, which is partly concealed by the ink applicator roller 16 in this side view. The actuating element 96 for the format adjustment is located on the drive side of the printing unit 10. It effects the pivoting movement, correlated with the variation in the spacing, of the swinging arm 18 accommodating the printing form cylinder 12 at two points about the impression cylinder 14. A first drive mandrel 98 to be connected to the first drive 38, which is located on the drive side, is accommodated on the side wall 28 holding the printing unit 10 (see FIG. 3). Furthermore, a second drive mandrel 100 is used to connect to the second drive 40, which is likewise fixed to the stone side wall 28. This embodiment has the drive train 64, closest to the stone side wall 28, for the movement of the printing form cylinder 12. The further drive train 78, for the movement of the impression cylinder 14, is located between the planes of the drive train 64 and the swinging arm 18.

Figure 6:
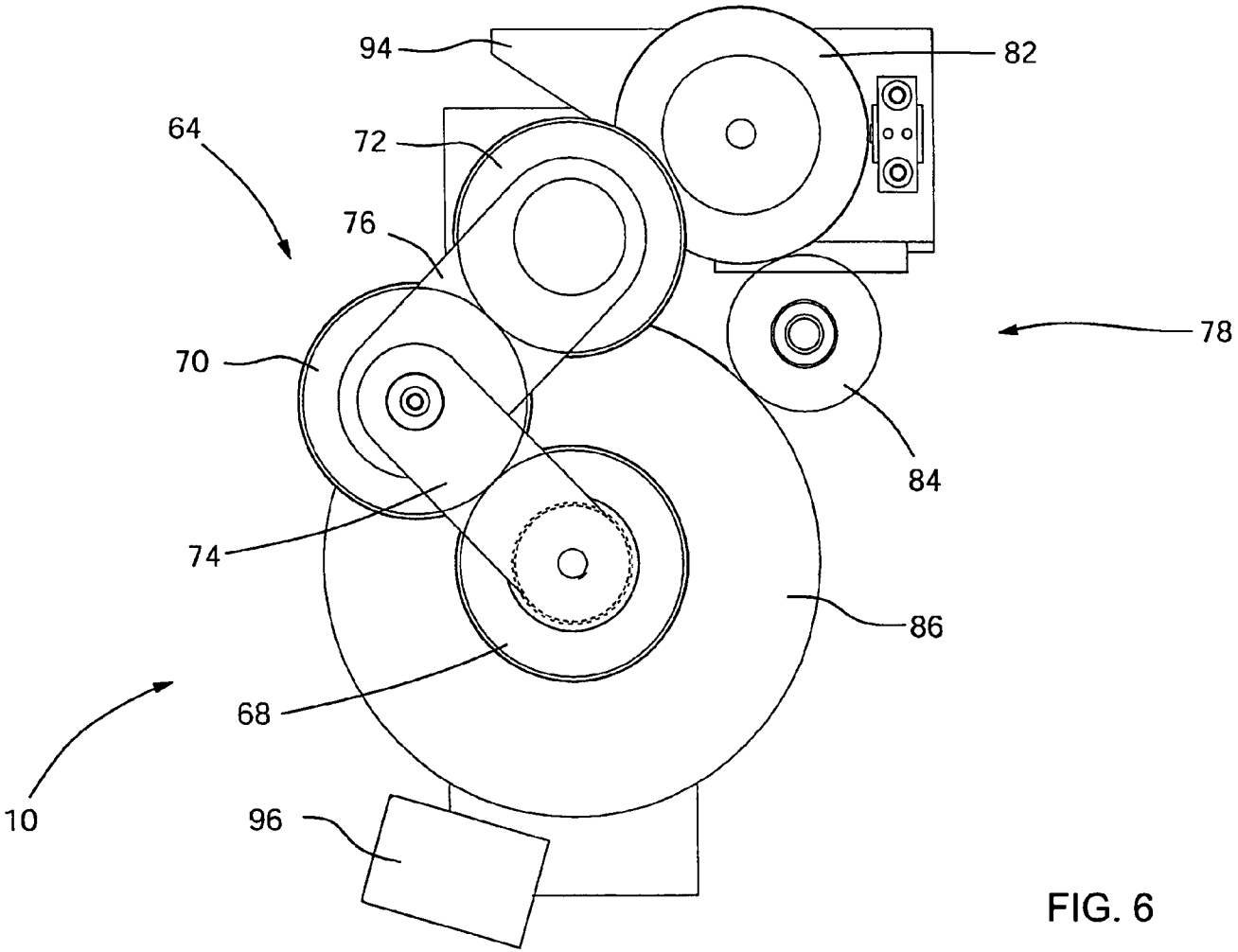
FIG. 6 is a drive-side elevational view of an embodiment of a printing unit according to the invention in a setting for a small printing format.

FIG. 6 shows a drive-side view of the embodiment of a printing unit 10 according to the invention from FIG. 4, in a setting for a small printing format. In this view, the drive train 64 located on the drive side of the printing form cylinder 12 can be seen to include the first drive gear 68 for the first drive 38, the first intermediate gear 70 connected to the first coupling arm 74 for this purpose and the driven gear 72, connected to the intermediate gear 70 by the second coupling arm 76, for the printing form cylinder 12. The other drive train 78 for the impression cylinder 14 includes the drive gear 82, the second intermediate gear 84 and the driven gear 86.

Figure 7:
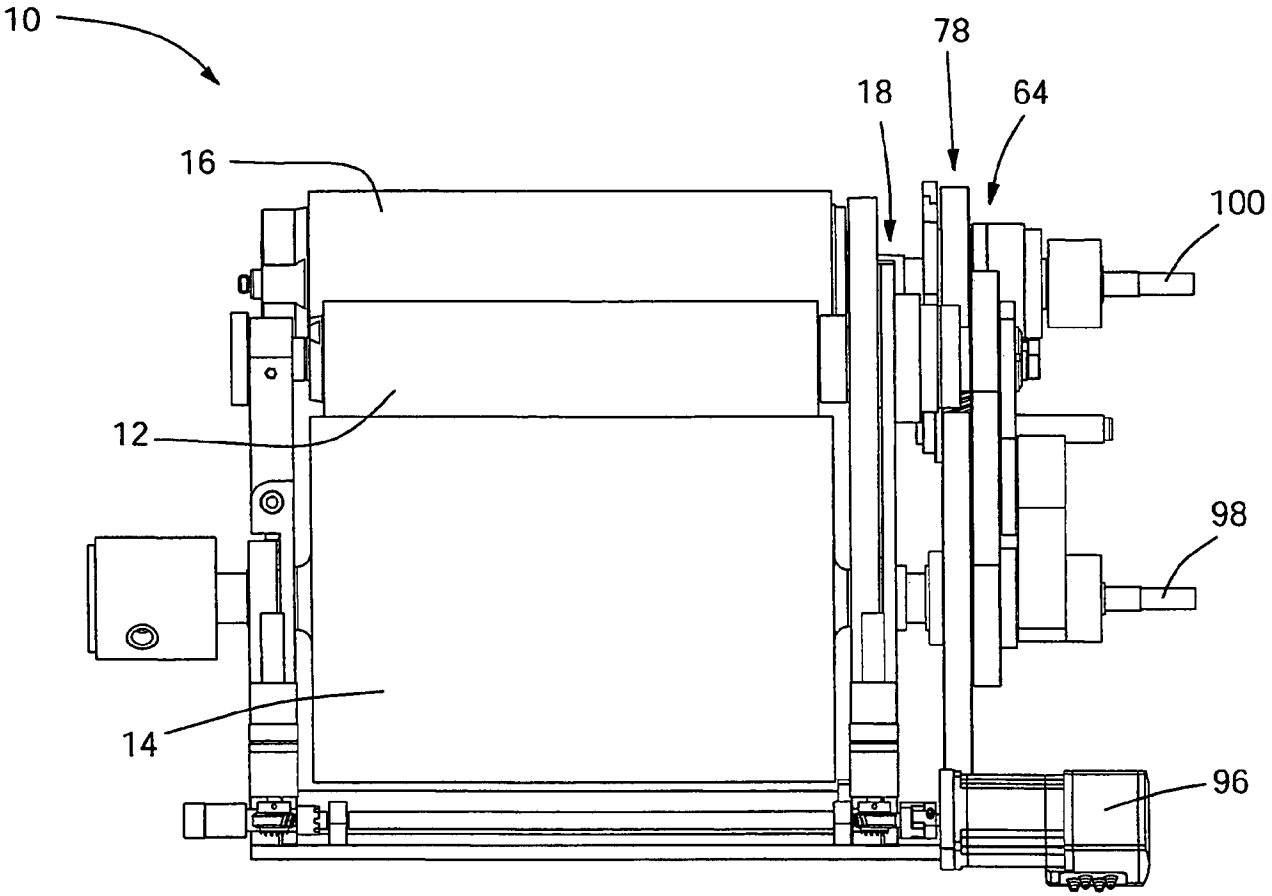
FIG. 7 is a second side-elevational view of an embodiment of a printing unit according to the invention in a setting for a small printing format.

FIG. 7 relates to a second side view of the embodiment of a printing unit 10 according to the invention from FIG. 4 in a setting for a small printing format. It is possible to see the impression cylinder 14 in a fixed location in the printing unit 10 and the printing form cylinder 12, which partly conceals the ink applicator roller 16 in this side view. The actuating element 96 for the format adjustment through the use of a pivoting movement of the swinging arm 18 and correlated variation of the spacing between the printing form cylinder 12 and the impression cylinder 14, is located on the drive side of the printing unit 10. The first drive mandrel 98, which is to be connected to the first drive 38 and is located on the drive side, is accommodated on the side wall 28 holding the printing unit 10 (see FIG. 3). Furthermore, the second drive mandrel 100 is used to connect to the second drive 40, that is likewise fixed to the stone side wall 28. The drive train 64 for the movement of the printing form cylinder 12 is located closest to the stone side wall 28. The further drive train 78 for the movement of the impression cylinder 14 is located between the planes of the drive train 64 and the swinging arm 18.

Figure 8:
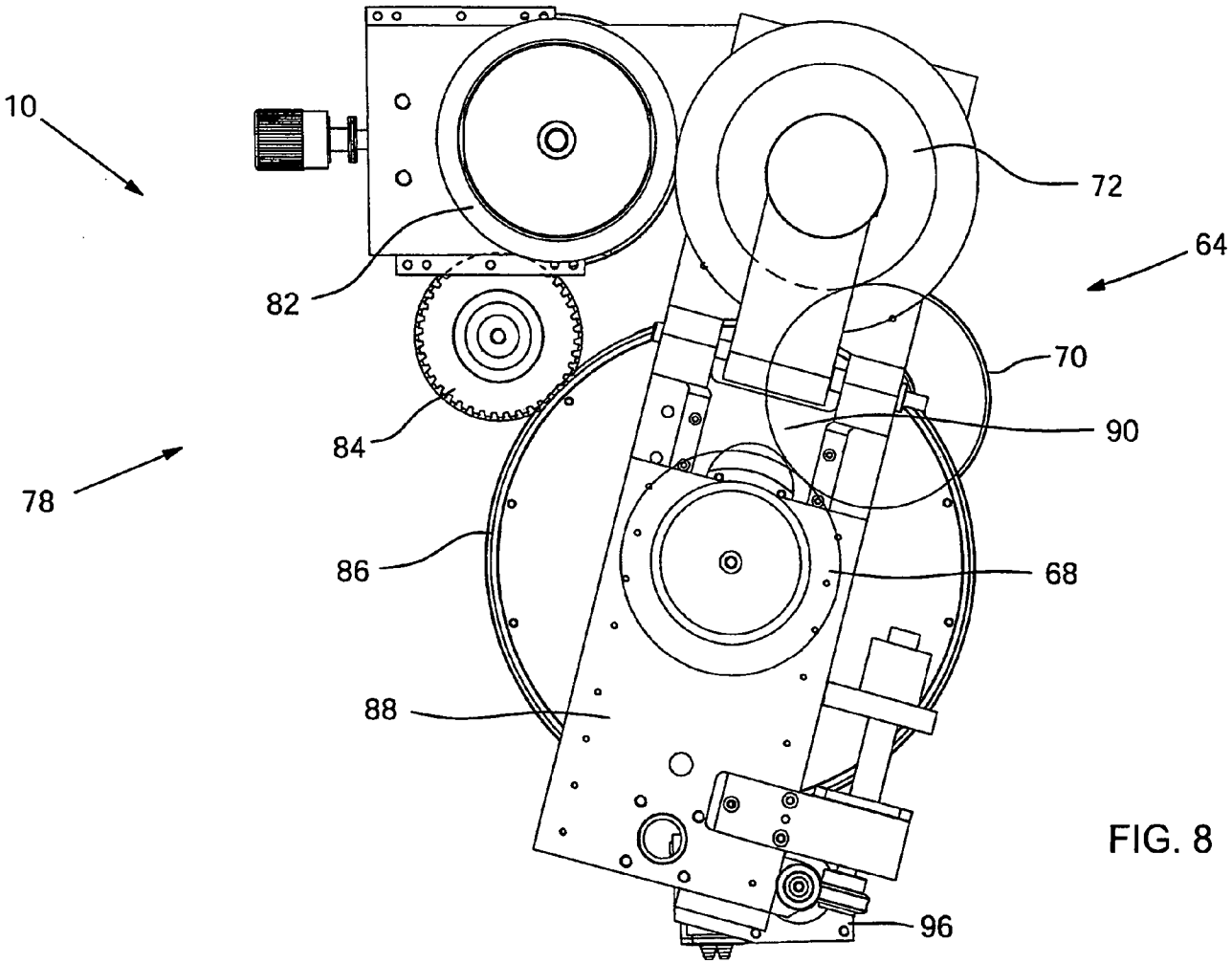
FIG. 8 is an operating-side elevational view of an embodiment of a printing unit according to the invention in a setting for a large printing format.

FIG. 8 shows the mechanism for implementing the individual movements in the printing unit 10 in an operating-side view of the embodiment of a printing unit 10 according to the invention, which was already described with reference to FIGS. 4 to 7, in a setting for a large printing format (the printing form cylinder 12 has a relatively large diameter and a relatively long circumferential length). The drive train 64 for the rotational movement of the printing form cylinder can also be seen in FIG. 8. The drive train 64 includes the first drive gear 68 for the first drive 38, the first intermediate gear 70 connected to the first coupling arm 74 for this purpose and the driven gear 72, connected to the intermediate gear 70 by the second coupling arm 76, for the printing form cylinder 12. The other drive train 78 for the impression cylinder 14 includes the gear train including the drive gear 82, the second intermediate gear 84 and the driven gear 86. In a setting for a large printing format, the axes of rotation of the printing form cylinder 12 and of the impression cylinder 14 have a relatively large spacing. At the same time, the axis of rotation of the printing form cylinder 12 and of the ink applicator roller 16 are likewise spaced apart to a relatively large extent. The slotted guide 88 with the linearly movable slider 90, which can be actuated by the actuating element 96, as compared with its position in the case of a small printing format (also see FIG. 4), is pivoted about the impression cylinder 14 in the direction facing away from the ink applicator roller.

Figure 9:
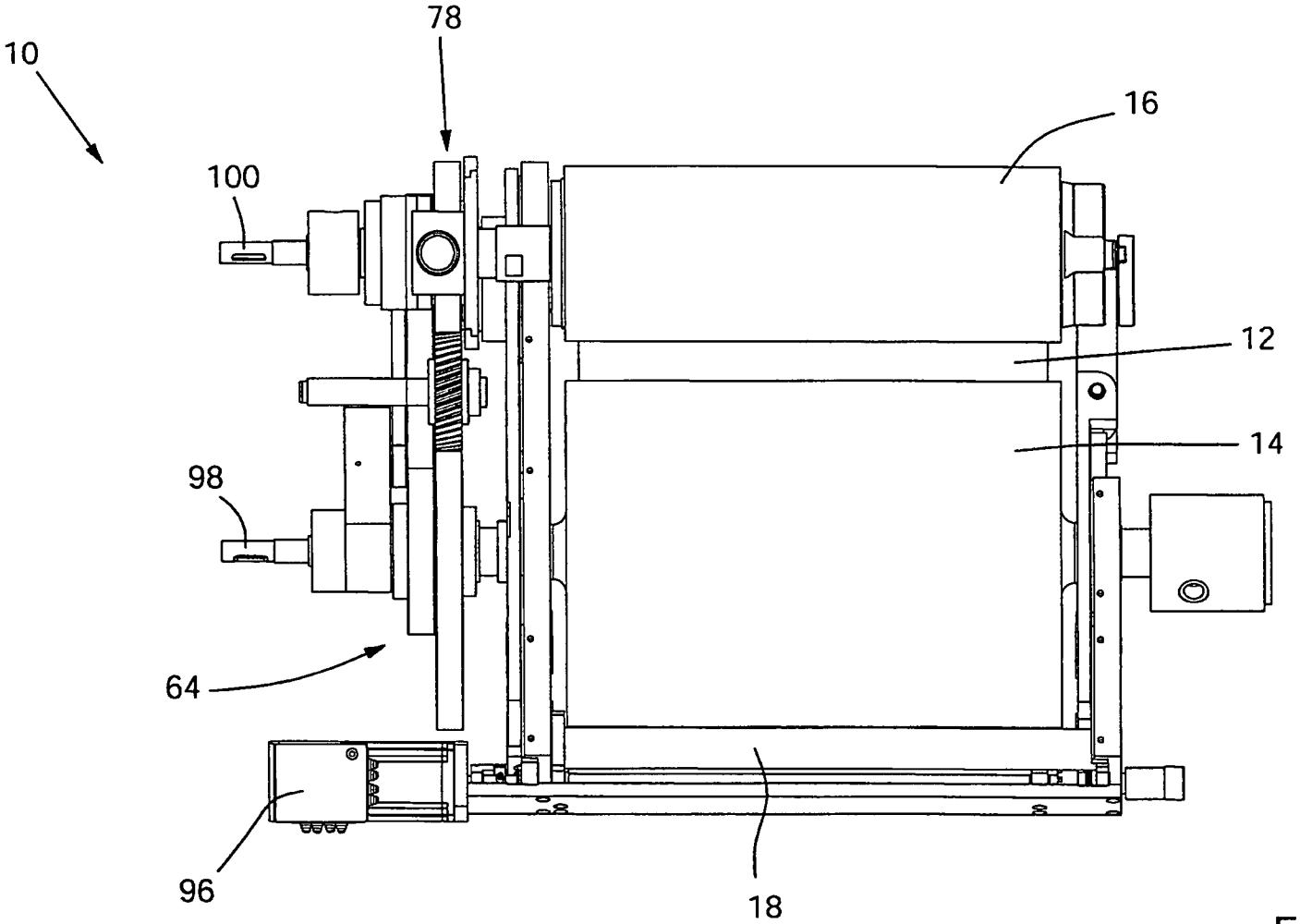
FIG. 9 is a first side-elevational view of an embodiment of a printing unit according to the invention in a setting for a large printing format.

In FIG. 9, a first side view of the embodiment of a printing unit 10 according to the invention from FIG. 8 can be seen in a setting for a large printing format. The fixed-location impression cylinder 14 together with the printing form cylinder 12 forms a press nip, which is located so as to be concealed in this illustration. The ink applicator roller 16 interacts with the printing form cylinder 12. As in FIG. 5, in this case too, the actuating element 96 for the format adjustment (through the use of the swinging arm 18), the first drive mandrel 98 for connecting the drive train 64 to the first drive 38, and the second drive mandrel 100 for connecting the other drive train 78 to the second drive 40, can be seen on the drive side. The first and second drives 38, 40 are fitted to the stone side wall 28 holding the printing unit 10 (see FIG. 3).

Figure 10:
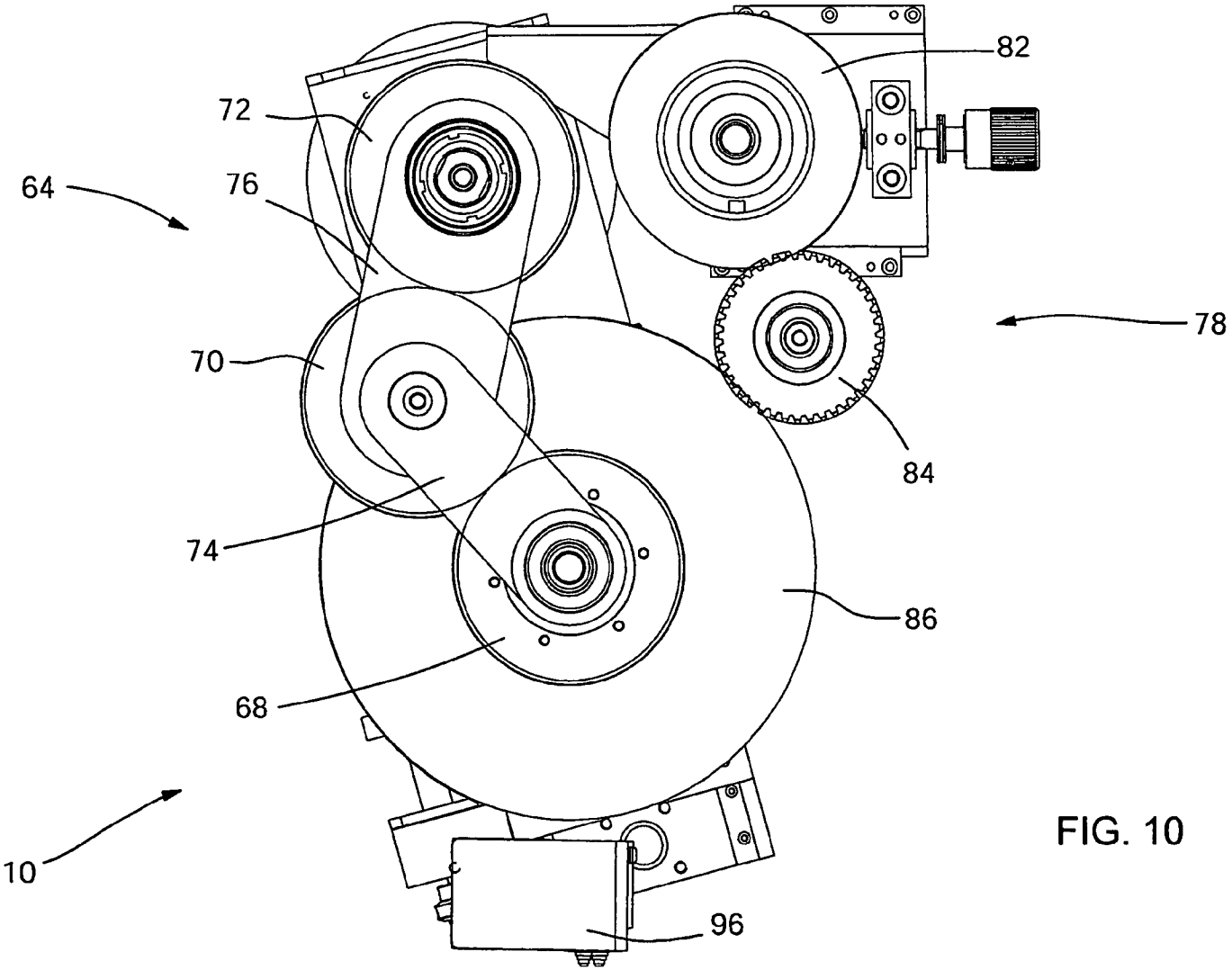
FIG. 10 is a drive-side view of an embodiment of a printing unit according to the invention in a setting for a large printing format.

FIG. 10 is a drive-side view of the embodiment of a printing unit 10 according to the invention from FIG. 8 in a setting for a large printing format. While the position of the other drive train 78 for the rotational movement of the impression cylinder 14 is unchanged as compared with the setting for a small printing format, the coupled gear train of the drive train 64 for the rotational movement of the printing form cylinder 12 (drive gear 68, first intermediate gear 70, driven gear 72, first coupling arm 74 and second coupling arm 76) is extended slightly and pivoted about the impression cylinder 14 in the direction facing away from the ink applicator roller 16.

Figure 11:
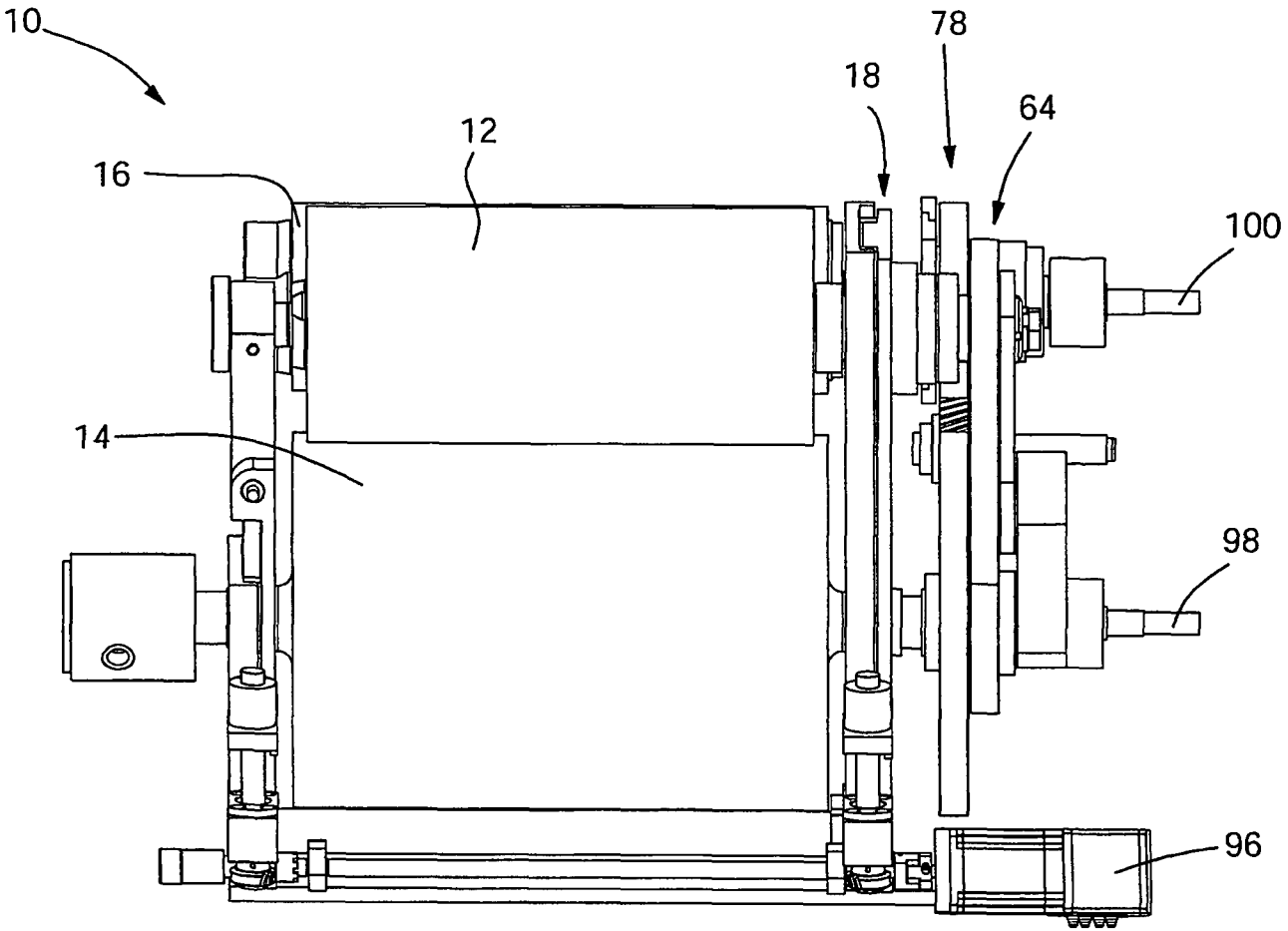
FIG. 11 is a second side-elevational view of an embodiment of a printing unit according to the invention in a setting for a large printing format.

FIG. 11 shows a second side view of the embodiment of a printing unit 10 according to the invention from FIG. 8 in a setting for a large printing format. The fixed-location impression cylinder 14 together with the printing form cylinder 12 forms a press nip, located so as to be concealed in this illustration. The ink applicator roller 16 located behind the printing form cylinder 12 interacts with the printing form cylinder 12. As in FIG. 5, in this case too, the actuating element 96 for the format adjustment (through the use of the swinging arm 18), the first drive mandrel 98 for connecting the drive train 64 to the first drive 38 and the second drive mandrel 100 for connecting the other drive train 78 to the second drive 40, can be seen on the drive side. The first and second drives 38, 40 are fitted to the stone side wall 28 holding the printing unit 10 (see FIG. 3).

The invention claimed is:

1. A printing unit, comprising:

an impression cylinder having an axis of rotation and a central cylinder axis;

a printing form cylinder having an axis of rotation, said printing form cylinder configured to be pivoted around said impression cylinder about a pivot axis running parallel to said axis of rotation of said impression cylinder;

said pivot axis of said printing form cylinder running along said central cylinder axis of said impression cylinder;

said axes of rotation of said impression cylinder and of said printing form cylinder defining a variable spacing there between;

said impression cylinder and said printing form cylinder configured to be set against each other to form a press nip in which a substrate can be printed;

a first fixed-location drive for producing a rotational movement of said printing form cylinder; and a drive train connecting said first drive to said printing form cylinder, said drive train including at least one component having a torque axis running through said impression cylinder.

2. The printing unit according to claim 1, wherein said first drive has a torque axis, and at least one of said torque axis of said first drive or said pivot axis run through said impression cylinder.

3. The printing unit according to claim 1, wherein the printing unit is configured to carry out a flexographic printing process or to carry out a book printing process or to carry out a gravure printing process.

4. The printing unit according to claim 1, which further comprises a gear train having gears coupled to one another by arms, said first drive being connected to said printing form cylinder through said gear train.

5. The printing unit according to claim 4, wherein said gear train includes first, second and third gears, a first coupling arm connecting said first gear to said second gear, and a second coupling arm connecting said second gear to said third gear.

6. The printing unit according to claim 1, wherein said first drive has a torque axis, and said torque axis of said first drive runs parallel to and/or is identical to said central cylinder axis of said impression cylinder.

7. The printing unit according to claim 1, wherein said first drive is a servo motor.

8. The printing unit according to claim 1, wherein said printing form cylinder is detachably connected in the printing unit, and printing form cylinders with different diameters can be accommodated in the printing unit.

9. The printing unit according to claim 1, wherein said printing form cylinder can accommodate intermediate sleeves with different diameters thereon.

10. A printing unit, comprising:

an impression cylinder having an axis of rotation;

a printing form cylinder having an axis of rotation, said printing form cylinder configured to be pivoted around said impression cylinder about a pivot axis running parallel to said axis of rotation of said impression cylinder;

said axes of rotation of said impression cylinder and of said printing form cylinder defining a variable spacing there between;

said impression cylinder and said printing form cylinder configured to be set against each other to form a press nip in which a substrate can be printed;

a first fixed-location drive for producing a rotational movement of said printing form cylinder;

a drive train connecting said first drive to said printing form cylinder, said drive train including at least one component having a torque axis running through said impression cylinder;

a guide cam being fixed in location or adjustable a guide cam follower connected to said printing form cylinder and a slider movable in a slotted guide to be pivoted about said pivot axis, said slider effecting contact between said guide cam follower and said guide cam, for carrying out a coupled pivoting movement and variation of said spacing between said axes of said printing form cylinder and said impression cylinder.

11. A printing unit, comprising:

an impression cylinder having an axis of rotation;

a printing form cylinder having an axis of rotation, said printing form cylinder configured to be pivoted around said impression cylinder about a pivot axis running parallel to said axis of rotation of said impression cylinder;

said axes of rotation of said impression cylinder and of said printing form cylinder defining a variable spacing there between;

said impression cylinder and said printing form cylinder configured to be set against each other to form a press nip in which a substrate can be printed;

a first fixed-location drive for producing a rotational movement of said printing form cylinder;

a drive train connecting said first drive to said printing form cylinder, said drive train including at least one component having a torque axis running through said impression cylinder;

a second fixed-location drive and another drive train connecting said impression cylinder to said second fixed-location drive.

12. The printing unit according to claim 11, which further comprises a gear train connecting said second drive to said impression cylinder.

13. The printing unit according to claim 11, wherein said second drive has a torque axis running outside said impression cylinder.

14. The printing unit according to claim 11, wherein said second drive is a servo motor.

15. A printing press, comprising at least one printing unit according to claim 1.

16. The printing press according to claim 15, which further comprises a transport device for moving the substrate, in the form of a web, through the printing press.

17. The printing press according to claim 15, wherein the printing press is a label printing press.

18. The printing press according to claim 15, wherein the printing press has a plurality of printing units operating in accordance with mutually different printing processes.

19. The printing press according to claim 18, wherein said different printing processes include at least one of the following printing processes:

flexographic printing, gravure printing, book printing, letterpress printing, direct or indirect planographic printing, lithographic printing, offset printing, water-free offset printing, cold film embossing printing, hot film embossing printing, inkjet printing, liquid toner printing, screen printing or xerographic printing.

20. The printing press according to claim 15, which further comprises a load-bearing element fabricated at least partly from stone, and a bearing element holding the printing unit in said load-bearing element.

21. The printing press according to claim 20, wherein said stone is a natural stone.

22. The printing press according to claim 21, wherein said natural stone is a granite, a granite-like rock, a granite porphyry, a gneiss or a marble.

23. The printing press according to claim 21, wherein said natural stone is a black granite, a gabbro or an impala granite.

24. The printing press according to claim 15, wherein the printing press has at least one of an in-line construction or a modular construction.

25. The printing press according to claim 15, which further comprises holding elements on which modules for different printing processes or for processing the substrate can be interchangeably accommodated and detachably connected.

26. A printing press, comprising at least one printing unit including:

an impression cylinder having an axis of rotation;

a printing form cylinder having an axis of rotation, said printing form cylinder configured to be pivoted around said impression cylinder about a pivot axis running parallel to said axis of rotation of said impression cylinder;

said axes of rotation of said impression cylinder and of said printing form cylinder defining a variable spacing there between;

said impression cylinder and said printing form cylinder configured to be set against each other to form a press nip in which a substrate can be printed;

a first fixed-location drive for producing a rotational movement of said printing form cylinder;

a drive train connecting said first drive to said printing form cylinder, said drive train including at least one component having a torque axis running through said impression cylinder;

a second fixed-location drive another drive train connecting said impression cylinder to said second fixed-location drive; and a frame wall on which the printing unit is held with said two fixed-location drives integrated into said frame wall.

27. A process for producing labels or self-adhesive labels in a printing press, the process comprising the following steps:

operating a printing press having at least one printing unit according to claim 1; and processing the substrate in web form suitable for production of labels or self-adhesive labels.

* * * * *